United States Patent [19]

Fries

[11] 4,108,239

[45] Aug. 22, 1978

[54] HEAT PIPE

[75] Inventor: Paul Fries, Erlangen, Fed. Rep. of Germany

[73] Assignee: Siemens Aktiengesellschaft, Berlin and Munich, Fed. Rep. of Germany

[21] Appl. No.: 668,929

[22] Filed: Mar. 22, 1976

[30] Foreign Application Priority Data

Apr. 10, 1975 [DE] Fed. Rep. of Germany ..... 2515753

[51] Int. Cl.[2] ..... F28D 15/00

[52] U.S. Cl. ..... 165/105

[58] Field of Search ..... 165/105

[56] References Cited

U.S. PATENT DOCUMENTS

| | | | |
|---|---|---|---|
| 3,229,759 | 1/1966 | Grover | 165/105 |
| 3,503,438 | 3/1970 | Geyer | 165/105 |
| 3,554,183 | 1/1971 | Grover | 165/105 X |
| 3,964,902 | 6/1976 | Fletcher | 165/105 X |

*Primary Examiner*—Charles J. Myhre
*Assistant Examiner*—Sheldon Richter
*Attorney, Agent, or Firm*—Kenyon & Kenyon, Reilly, Carr & Chapin

[57] ABSTRACT

A heat pipe is disclosed which carries an evaporable working fluid and which includes a wick. More particularly, in accordance with the invention the wick comprises a first layer having a small-pore structure and disposed adjacent the vapor space within the pipe and a second layer having a large-pore structure and disposed adjacent the first layer.

8 Claims, 3 Drawing Figures

HEAT PIPE

BACKGROUND OF THE INVENTION

1. Field of the Invention

This invention relates to a heat pipe and, in particular, a heat pipe which carries an evaporable working fluid and which includes a wick.

2. Description of the Prior Art

In a known heat pipe of the above type, the wick is in the form of a hollow, cylindrical member having an outer surface which rests against the inside diameter of the wall of the pipe and an inner surface which is adjacent a vapor space extending through the central portion of the interior of the pipe. Additionally, the pipe is evacuated and filled with a small amount of an evaporable working fluid, such as, e.g., water or alcohol. In use, one end of the pipe is brought into contact with a heat source from which heat is to be removed and, simultaneously, therewith the opposite end of the pipe is cooled. At the end adjacent the heat source an evaporation section or region is created where the working fluid in the wick evaporates and the resultant vapor enters into the vapor space. In turn, at the other end of the pipe a condensation section is formed. Since the vapor pressure in the region of the evaporation section is higher than in the region of the condensation section, the vapor molecules move through the vapor space from the evaporation section toward the condensation section. In the latter section the evaporated working fluid is condensed and is drawn back into the wick through capillary action along the wick surface adjacent the vapor space. The wick then carries the fluid back to the evaporation section where the cycle of operation is again repeated.

In the above known heat pipe, the wick is typically comprised of netting, felt or sintered layers, which have a homogeneous structure with substantially uniform pore size over the entire layer thickness. As a result of employing a wick with a uniform pore size, one is faced with having to select a single pore size which best satisfies two contradictory requirements. Small pores, on the one hand, permit large capillary pressure differences and, therefore, good absorption of the condensed vapor back into the wick. On the other hand, small pores offer increased resistance to the reflow of the condensed working fluid back through the wick, which counteracts the good absorption capacity. Large pores have just the opposite effect, i.e., offer low resistance to reflow of the condensed working fluid, but provide the small capillary pressure differences. In this known heat pipe, therefore, selection of the wick pore size necessarily involves a compromise between achieving maximum reflow and maximum capillary pressure differences.

In another known heat pipe an attempt has been made to overcome the latter disadvantage by providing separate, free canals, so-called "arteries" for the backward flow of the working fluid. For working fluids which boil quickly such as, for example, water or alcohol, these so-called "artery heat pipes" have not proved satisfactory, as the backward flow of the working fluid in the free canals is blocked by the formation of steam bubbles.

It is an object of the present invention to provide a heat pipe having an increased heat removing capacity.

SUMMARY OF THE INVENTION

In accordance with the principles of the present invention the above and other objectives are realized in a heat pipe of the above type by including therein a wick which includes a first layer which is disposed adjacent the vapor space in the pipe and has a small-pore structure and a second layer which is disposed adjacent the first layer and has a large-pore structure. Preferably, the pore diameter of the pores of the first layer should be less than one-half the pore diameter of the pores of the second layer.

With the heat pipe so configured, the return of the working fluid is improved by the large capillary force of the fine-pore layer and the low flow resistance of the large-pore layer. The amount of heat that can be removed is thereby increased.

In order to ensure the lack of steam bubble formation the wick may be further provided with another layer having a small-pore structure and disposed adjacent the second layer and the inner wall of the pipe. Additionally, to further facilitate the return of the evaporated liquid the thickness of the fine-pore layer may be substantially smaller than the thickness of the large-pore layer.

In one embodiment of the heat pipe to be disclosed herein the large-pore layer of the wick comprises several layers of a wide-mesh net and the small-pore layer comprises a fine-mesh net. In another embodiment to be disclosed, the large-pore layer of the wick is in the form of a hollow, cylindrical, sintered layer and the small-pore layer a thin sintered layer or fine-mesh net.

BRIEF DESCRIPTION OF THE DRAWINGS

The above and other features and aspects of the present invention will become more apparent upon reading the following detailed description in conjunction wih the accompanying drawings, in which.

DETAILED DESCRIPTION

Figure 1:
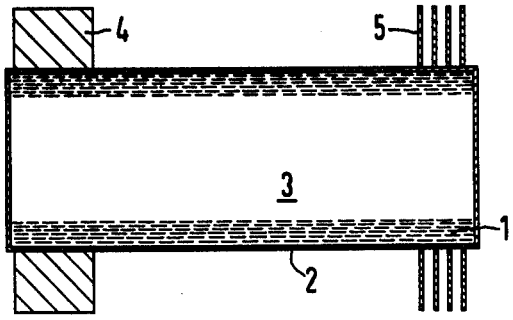
FIG. 1 shows a heat pipe in accordance with the principles of the present invention.

FIG. 1 shows a heat pipe in accordance with the principles of the present invention. As shown, the heat pipe includes a hollow, cylindrical wick 1 having an outer surface which rests against the inside diameter of the wall 2 of the pipe and an inner surface which is adjacent a vapor space 3 extending through the central portion of the interior of the pipe. Additionally, the pipe is evacuated and filled with a small amount of an evaporable working fluid, such as, for example, water or alcohol. One end of the heat pipe is brought into contact with a heat source, for instance, a hot component 4, from which heat is to be removed. The opposite end of the heat pipe is simultaneously cooled, via the cooling fins 5.

As can be appreciated, with the heat pipe so constructed an evaporation section is formed in the region of the hot component 4 where the working fluid in the wick evaporates and the vapor enters into the vapor space 3. As can be also appreciated, a condensation section is formed in the region of the cooling fins 5. Since the vapor pressure in the region of the evaporation section is higher than that in the region of the condensation section, the evaporated working fluid moves from the evaporation section toward the condensation section. In the latter section, the evaporated fluid is condensed and is drawn radially back into the wick through capillary action along the wick surface adjacent the vapor space. The wick then carries the fluid axially back to the evaporation section where it is again evaporated.

In accordance with the principles of the present invention, the wick 1 is formed so as to include a first layer which is adjacent the vapor space 3 and which has a small-pore structure and a second layer which is adjacent the first layer and has a large-pore structure. Preferably, the pore diameter of the small pores of the first layer should be less than one-half the pore diameter of the large pores of the second layer.

With the wick so formed, the backward transport (axial flow) of the condensed working fluid takes place in the large-pore layer of the wick. These large pores prevent the transport path from getting blocked by formation of steam bubbles. Additionally, the large pores form a substantially free flow cross section which offers little resistance to the axially backward flow of the condensed working fluid. As a result, maximum backward flow can be realized. Also, the absorption of the condensed vapor into the wick at the condensation region is now controlled by the small-pore layer. The small pores of the latter layer provide maximum capillary action (radial flow) and, hence, maximum absorption of the condensed fluid radially back into the wick is also achieved.

The amount of heat which can be removed by the present heat pipe can be increased over heat pipes having wicks with homogeneous pore structures by a factor which corresponds approximately to the ratio of the pore diameters of the large-pore layer to the small-pore layer. The ratio of the pore diameters can, therefore, be determined by the desired capacity increase over a heat pipe whose wick has a homogeneous, small-pore structure. Additionally, as compared to the latter type heat pipe, the present heat pipe can be, for the same amount of heat capacity, longer and/or thinner and work better against the force of gravity. Also, in the present heat pipe there is more freedom as to the choice of the working fluid.

As capillary action takes place only at the boundary surface between the first layer of the wick and the vapor space 3, the thickness of the fine-pore first layer may be substantially smaller than the thickness of the large-pore second layer. In such case, the large-pore second layer serves as a carrier or support for the very thin small-pore first layer.

The choice of the suitable pore diameter of the first and second layers of the wick depends particularly on the physical properties of the working fluid. The pores in the large-pore layer should be as large as possible. The maximum size of the pores is limited by the start of steam bubble formation due to the delay in boiling of the working fluid. When water is used as the working fluid, a pore diameter between 0.1 mm and 1 mm, and preferably about 0.5 mm, is found to be advantageous for the large-pore second layer.

The pores of the small-pore first layer should be as small as possible to produce a capillary force as large as possible. The minimum size of the pores is limited by the producibility of the small-pore layer. When water is used as the working fluid, a pore diameter between 5 $\mu$m to 100 $\mu$m and, preferably, a pore diameter of about 25 $\mu$m, is found to be advantageous for the small-pore layer.

Within the limits mentioned, the choice of layers with suitable pore diameters will also be determined by their producibility. It is essential, however, that the ratio of the pore diameter of the large-pore layer to the small-pore layer be as large as possible.

Figure 2:
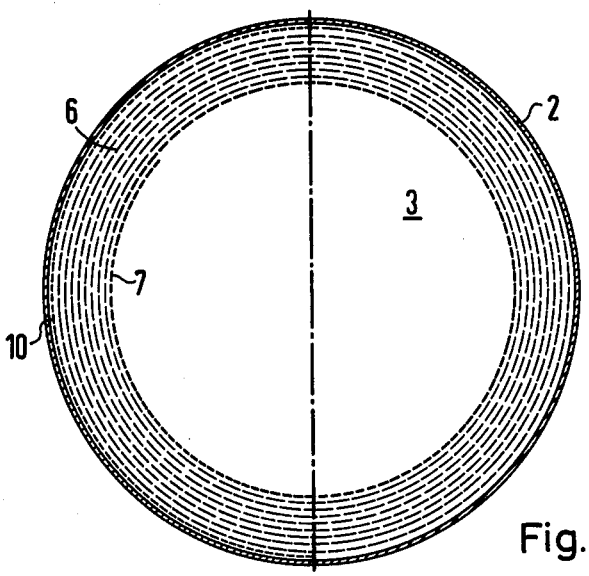
FIG. 2 illustrates two configurations for the wick employed in the heat pipe of FIG. 1.

The right half of FIG. 2 shows an embodiment of the wick of FIG. 1 in which the second large-pore layer is wound of several layers of a wide-mesh net 6 and the first small-pore layer consists of a fine-mesh net 7. To produce such a wick one or both ends of a wide-mesh net in tape form are attached to one or two pieces of a fine-mesh net. The entire tape is then wound on a mandrel, the diameter of which is smaller than the inside diameter of the heat pipe. The wound net is then placed inside the pipe and makes close contact with the pipe wall 2. When water is used as the working fluid, netting of phosphor bronze is found to be particularly corrosion resistant. Such phospor bronze netting can also be made with a very large number of meshes per unit of area.

In the left-hand portion of FIG. 2 the wick of the right-hand portion has been modified to include a third layer 10, which is adjacent the second layer 6 and the inner wall 2. The third pore layer has a small-pore structure similar to that of first layer 7. The presence of the layer 10 further inhibits any tendency of the wick to form steam bubbles, which would prevent backward passage of the condensed liquid.

Figure 3:
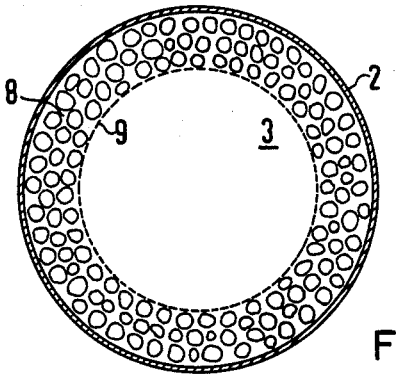
FIG. 3 shows a further configuration for the wick employed in the heat pipe of FIG. 1.

FIG. 3 shows another embodiment of the wick of FIG. 1 in which the layers thereof comprise sintered material. More particularly, a thick layer 8 of large-pore structure sintered material is lined at its inside surface with a thin layer 9 of small-pore structure sintered material. As can be appreciated, the inner layer 9 may be replaced by a fine-mesh net having a small-pore structure.

It should be also pointed out that the first and second layers of the wick of FIG. 1 can be constructed of steel wool or felt having the required pore structure.

What is claimed is:

1. A heat pipe adapted to carry an evaporable working fluid comprising:

a wick disposed within the interior of said pipe so as to form a vapor space therein, said wick including a first layer which is situated adjacent said vapor space and which has a small-pore structure and a second layer which is situated adjacent said first layer and which has a large-pore structure, the diameter of the pores of said first layer being less than one-half the diameter of the pores of said second layer, said first layer constituting the boundary surface of said second layer to said vapor space and being a single layer of fine mesh net.

2. A heat pipe in accordance with claim 1 in which said wick includes a third layer which is situated adjacent said second layer and the interior wall of said pipe.

3. A heat pipe in accordance with claim 1 in which the pores of said first layer have a diameter within a range from 5 $\mu$m to 100 $\mu$m.

4. A heat pipe in accordance with claim 1 in which the pores of said first layer have a diameter equal to 20 $\mu$m.

5. A heat pipe in accordance with claim 1 in which said second layer is wound from several layers of wide mesh net.

6. A heat pipe in accordance with claim 1 in which said second layer is a hollow, cylindrical sintered layer.

7. A heat pipe in accordance with claim 1 in which the pores of said second layer have a diameter within a range of 0.1 mm to 1 mm.

8. A heat pipe in accordance with claim 7 in which the pores of said second layer have a diameter equal to 0.5 mm.

* * * * *